137-13.
1-20-76 XR 3,933,003 SR

United States Patent [19]
Markum

[11] 3,933,003
[45] Jan. 20, 1976

[54] CRYOSTAT CONTROL

[75] Inventor: Arvel Dean Markum, San Juan Capistrano, Calif.

[73] Assignee: General Dynamics Corporation, Pomona, Calif.

[22] Filed: Jan. 6, 1975

[21] Appl. No.: 538,651

Related U.S. Application Data

[62] Division of Ser. No. 464,078, April 25, 1974, Pat. No. 3,885,939.

[52] U.S. Cl. ..... 62/85; 62/195; 62/514; 137/13

[51] Int. Cl.[2] ..... F25B 47/00

[58] Field of Search ..... 137/13; 62/514, 85, 474, 62/195, 55

[56] References Cited

UNITED STATES PATENTS

| | | | |
|---|---|---|---|
| 2,002,383 | 5/1935 | Witt | 137/13 X |
| 3,270,756 | 9/1966 | Dryden | 137/13 |
| 3,314,473 | 4/1967 | Smith et al. | 62/514 X |
| 3,631,870 | 1/1972 | Livingston | 137/13 |

*Primary Examiner*—William F. O'Dea
*Assistant Examiner*—Ronald C. Capossela
*Attorney, Agent, or Firm*—Albert J. Miller; Edward B. Johnson

[57] ABSTRACT

Flow control for a cryostat in which the refrigerant flow rate is controlled by adding a contaminant to the refrigerant.

10 Claims, 3 Drawing Figures

CRYOSTAT CONTROL

CROSS-REFERENCE TO RELATED APPLICATION

This application is a divisional application of U.S. Pat. application Ser. No. 464,078, filed Apr. 25, 1974, now U.S. Pat. No. 3,885,939, and assigned to the same assignee.

BACKGROUND OF THE INVENTION

Joule-Thomson effect cooling devices, commonly referred to as cryostats, are well known in the art to produce cryogenic temperature levels. The cryostats may be employed to maintain radiation sensing devices at the extremely low temperatures required. Examples of conventional Joule-Thomson effect cryostats may be found in U.S. Pat. Nos. 2,991,633, 3,095,711, 3,353,371, 3,415,078 and 3,431,750.

In order to achieve a rapid initial cool-down, large coolant or refrigerant flows are required in conventional cryostats. Only a fraction of this cool-down flow is, however, needed for steady state operation of the cryostat. Thus, a cryostat designed to meet the initial cool-down flow requirements would be inherently inefficient during steady state operation, while a more efficient steady state flow design would have an excessively long cool-down period.

Since in many cryostat applications the coolant or refrigerant flow is limited by the available supply, techniques have been developed to provide sufficient cool-down flow without providing excessive steady state flow. While certain self-regulating flow control mechanisms have been developed for cryostats, these mechanisms, which have been either thermal-mechanical, electro-mechanical, or chemical in nature, have been rather complicated, overly complex and often prone to operational difficulties. All rely upon external forces, thus consuming energy such as electrical power and all include at least some moving parts. In some cases the basic cooling characteristics of the cryostat have been altered by the flow regulating mechanism.

SUMMARY OF THE INVENTION

The invention is directed to a cryostat flow control in which the refrigerant flow rate is controlled by the addition of a contaminant or foreign fluid to the refrigerant. After initial cool-down, the contaminant, having a higher solidification point than the refrigerant, will solidify in the cryostat and cause a partial or complete refrigerant flow stoppage. When the refrigerant flow is thus reduced or stopped, refrigeration slows or ceases with a resultant rise in cryostat temperature which in turn then melts the solidified contaminant. The refrigerant flow will then resume until the temperature is again reduced to freeze up or solidify the refrigerant contaminant.

The alternate freeze-up and melting cycle achieves a greatly reduced average steady state refrigerant flow rate.

DESCRIPTION OF THE PREFERRED EMBODIMENTS

Figure 1:
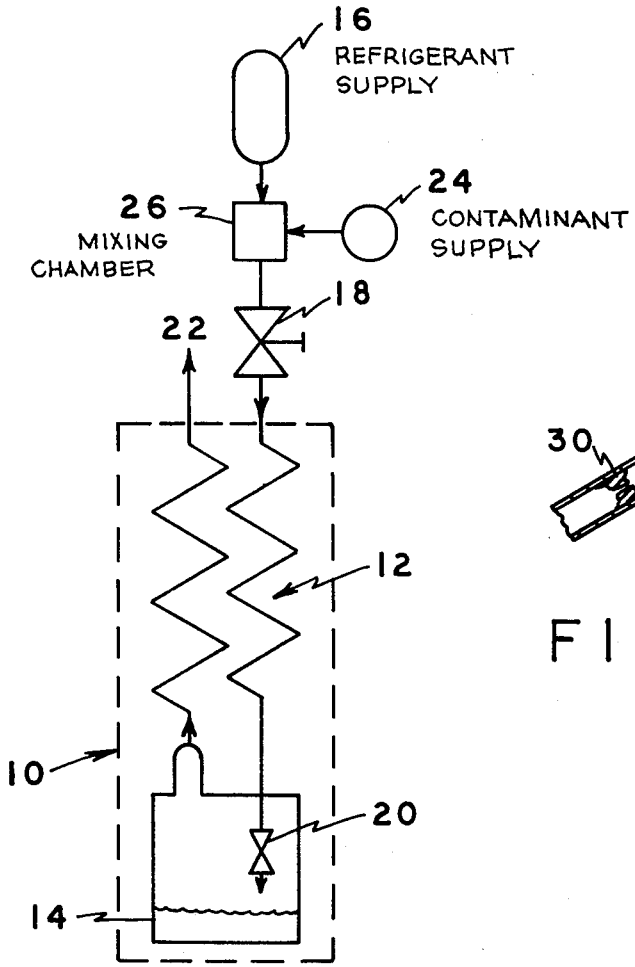
FIG. 1 is a schematic illustration of a cryostat utilizing the control of the present invention.

The cryostat control of the present invention is applicable to any type of cryostat (counterflow, regenerative, Joule-Thomson expansion, etc.). For purposes of illustration, a Joule-Thomson expansion cryostat 10 having a coiled tubing heat exchanger 12 and liquid refrigerant reservoir 14 is illustrated in FIG. 1. A high pressure refrigerant gas supply 16 provides refrigerant to the heat exchanger 12 through a control valve 18. The refrigerant cooled in the inlet side of the heat exchanger 12 is expanded through an expansion valve 20, or alternately through a nozzle or orifice, and collected in the liquid refrigerant reservoir 14. The liquid refrigerant is then discharged from the cryostat 10 through a refrigerant exhaust 22 after passing through the other side (outlet side) or heat exchanger 12.

Initially, the refrigerant gas is at the same temperature as its surroundings. When admitted to the cryostat 10 it passes through the inlet side of the heat exchanger 12 and out from the heat exchanger 12 through the expansion valve or nozzle 20. As the refrigerant expands through the expansion valve 20, it drops in temperature because of the Joule-Thomson effect. This lower temperature refrigerant is then forced through the outlet side of the heat exchanger 12 and thereby decreases the temperature of the incoming refrigerant. This incoming refrigerant then expands through the expansion valve 20 and drops to an even lower temperature than the preceding increment of refrigerant. This process continues until such time that the refrigerant becomes liquefied at the expansion nozzle 20. The system then remains stabilized at the boiling temperature of the refrigerant.

In order to effect control of the cryostat 10 in accordance with the present invention, a gaseous contaminant or foreign fluid is introduced into the refrigerant from a contaminant supply 24. A mixing chamber 26 may be provided to uniformly distribute or disperse the contaminant vapor throughout the refrigerant supplied to the cryostat 10. Alternately other methods of agitation, stirring, or heating may be utilized for this purpose.

Figure 3:
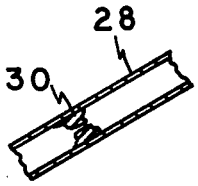
FIG. 3 is a graphical representation of the operational cycle of a cryostat having the flow control of the present invention.
Figure 2:
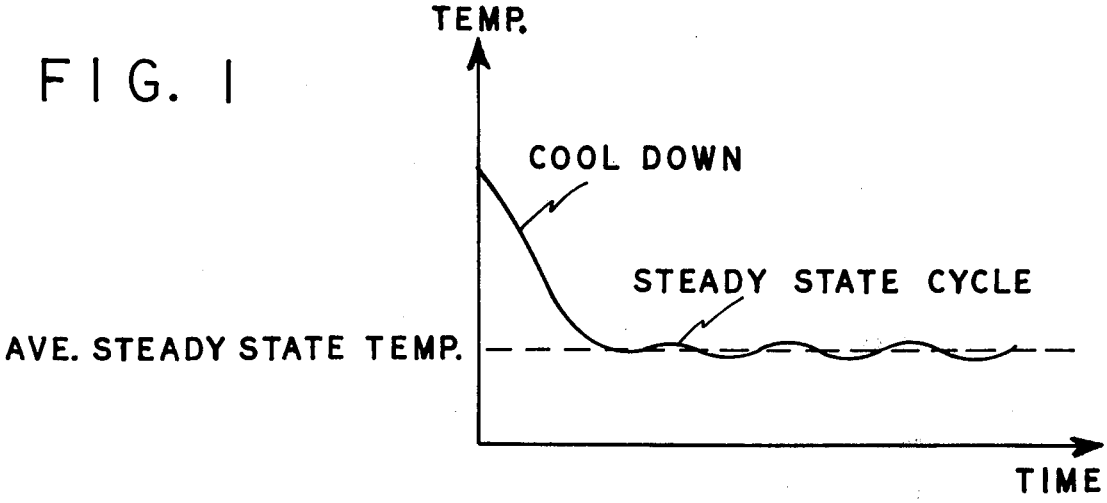
FIG. 2 is an enlarged section view of a portion of the heat exchanger tube of the cryostat of FIG. 1.

As illustrated most clearly in FIG. 2, once cool-down has been achieved, the contaminant 30, having a solidification temperature higher than that of the refrigerant, will precipitate out of solution from the refrigerant and freeze-up. This will reduce and eventually block the flow of refrigerant through the heat exchanger tube 28. As the refrigerant flow is reduced, refrigeration slows or ceases until the cryostat temperature rises and melts the solidified contaminant. Refrigerant flow then resumes and decreases the cryostat temperature until the contaminant blockage occurs again. The cycle of alternate freeze-up and melting occurs indefinitely until the refrigerant supply is stopped. The operation of the cryostat is graphically illustrated in FIG. 3.

The type of contaminant, ratio of contaminant weight to refrigerant weight and the type of refrigerant can be varied to accommodate any desired cooling cycle and cryostat configuration. The maximum temperature reached during cycling, and the frequency of the cycling is dependent upon the percentage by weight of contaminant in the refrigerant gas supply.

In a 0.118 inch diameter, 1½ inch long, finned tube cryostat, having a gas flow rate of 1.1 standard liters per minute of 16% Freon-14 and 84% Freon-23 at a supply pressure of 500 pounds per square inch, 10 parts per million by weight of water vapor as a contaminant in the refrigerant will cycle the refrigerated tip of the cryostat from 250° Kelvin to 170° Kelvin at about 10 second intervals. While the exact location of the refrigerant flow blockage was not determined, it is believed to occur near or at the expansion nozzle.

Any desired coolant cycle can be tailored by proper selection of the refrigerant and contaminant in the proper proportions. A list of possible cooling cycles is provided below.

| Temperature Range | Refrigerant | Contaminant |
|---|---|---|
| 195° - 275°K | Freon - 23 | Water Vapor |
| 145° - 275°K | Freon - 14 | Water Vapor |
| 145° - 165°K | Freon - 14 | Xenon |
| 112° - 165°K | Methane | Xenon |
| 88° - 120°K | Argon | Krypton |
| 78° - 120°K | Nitrogen | Krypton |
| 78° - 95°K | Nitrogen | Methane |

This flow regulation control utilizes the cooling capacity of the refrigerant to solidify the introduced contaminant in the refrigerant within the cryostat flow passages. There are no moving parts or external forces required for flow control and the basic cooling characteristics of the refrigerant are not altered.

In this manner the full refrigerant flow is available for the initial cryostat cool-down which occurs well above the solidification point of the contaminant. Once, however, the cryostat operating temperature is achieved, the cyclical freezeup will significantly reduce the flow of refrigerant flow through the cryostat.

While specific embodiments of the invention have been illustrated and described, it is to be understood that these embodiments are provided by way of example only and that the invention is not to be construed as being limited thereto, but only by the proper scope of the following claims.

What I claim is:

1. A method of automatically controlling the flow of refrigerant in a cryostat comprising the steps of:

selecting a cooling cycle for the cryostat to be automatically controlled;

selecting and providing a refrigerant gas supply for the cryostat to meet the requirements of said selected cooling cycle;

selecting and providing a contaminant for the cryostat to meet the requirements of said selected cooling cycle, said contaminant having a solidification point higher than that of said refrigerant;

introducing said contaminant into said refrigerant supply; and alternately and automatically solidifying and melting said contaminant in the cryostat to reduce the flow of said refrigerant through the cryostat.

2. The method of claim 1, wherein said selected cooling cycle comprises a range of 195°K to 275°K and said selected refrigerant is Freon-23 and said selected contaminant is water vapor.

3. The method of claim 1, wherein said selected cooling cycle comprises a range of 145°K to 275°K and said selected refrigerant is Freon-14 and said selected contaminant is water vapor.

4. The method of claim 1, wherein said selected cooling cycle comprises a range of 145°K to 165°K and said selected refrigerant is Freon-14 and said selected contaminant is xenon.

5. The method of claim 1, wherein said selected cooling cycle comprises a range of 112°K to 165°K and said selected refrigerant is methane and said selected contaminant is xenon.

6. The method of claim 1, wherein said selected cooling cycle comprises a range of 88°K to 120°K and said selected refrigerant is argon and said selected contaminant is krypton.

7. The method of claim 1, wherein said selected cooling cycle comprises a range of 78°K to 120°K and said selected refrigerant is nitrogen and said selected contaminant is krypton.

8. The method of claim 1, wherein said selected cooling cycle comprises a range of 78°K to 95°K and said selected refrigerant is nitrogen and said selected contaminant is methane.

9. The method of claim 1, wherein said selected cooling cycle comprises a range of 170°K to 250°K and said selected refrigerant comprises a mixture of Freon-14 and Freon-23 and said selected contaminant is water vapor.

10. A method of automatic flow control for a cryostat having a selected cooling cycle between 170°K and 250°K comprising the steps of:

selecting and providing a refrigerant gas supply for the cryostat comprising a mixture of 16% Freon-14 and 84% Freon-23;

selecting and providing a contaminant for the cryostat having a solidification point higher than that of said refrigerant, said contaminant comprising 10 parts per million by weight water vapor; and alternately and automatically solidifying and melting said contaminant in the cryostat to reduce the flow of said refrigerant through the cryostat.

* * * * *